US005143211A

United States Patent [19]

Miczka et al.

[11] Patent Number: 5,143,211

[45] Date of Patent: Sep. 1, 1992

[54] MULTI-CHAMBERED CONTAINER

[75] Inventors: Lothar Miczka; Mathias Pauls, both of Appenzell; Ricco Kehl, Eichberg, all of Switzerland

[73] Assignee: Rathor Ag, Appenzell, Switzerland

[21] Appl. No.: 340,373

[22] Filed: Apr. 19, 1989

[30] Foreign Application Priority Data

Apr. 22, 1988 [EP] European Pat. Off. ..... 88106451

[51] Int. Cl.[5] ..... B65D 25/08

[52] U.S. Cl. ..... 206/221; 206/219; 604/218; 604/236

[58] Field of Search ..... 206/219, 221; 604/218, 604/222, 224, 236; 141/27; 215/DIG. 8; 604/236

[56] References Cited

U.S. PATENT DOCUMENTS

| | | | |
|---|---|---|---|
| 3,756,390 | 9/1973 | Abbey et al. | 206/219 |
| 3,779,371 | 12/1973 | Rovinski | 206/221 |
| 4,479,578 | 10/1984 | Brignola et al. | 206/221 |
| 4,632,672 | 12/1986 | Kvierud | 604/222 |
| 4,799,801 | 1/1989 | Bruning | 206/219 |

*Primary Examiner*—David T. Fidei
*Attorney, Agent, or Firm*—Price, Heneveld, Cooper, DeWitt & Litton

[57] ABSTRACT

In a multi-chamber container (1), in which is accomodated at least one chamber partition wall (4) movable through the two chambers and having at least one orifice (8) which makes a connection between the two adjacent chambers (2, 3) and interacts with a shutoff member and which can be opened and closed via a tappet (10) actuable from outside, the chamber partition wall (4) sealed off on the inside of the container being movable through the container (1), according to the invention the orifice (8) in the chamber partition wall (4) is equipped to receive a thread of a valve spindle (23) which can be screwed in by means of the tappet and which terminates at a stop (24) interacting with one side (26) of the chamber partition wall (4) and at a valve plate (32) formed by a ring (32) of the rod and ensuring sealing on the opposite side (35) of the chamber partition wall (4), the valve plate (24) and the stop (32) being layable onto their seats (27, 23) as a result of an alternating rotation of the rod (10), and the valve plate (32) closing the connection between the two chambers (2, 3), which, when the valve plates (24, 32) are lifted off, is opened and which is formed by longitudinal grooves (28, 31) of the valve spindle (23), these reaching as far as the stop (24) located at the free end of the spindle (23) and terminating at a distance from the valve plate (32) formed by the ring (32).

13 Claims, 4 Drawing Sheets

MULTI-CHAMBERED CONTAINER

The invention relates to a multi-chamber container [according to the preamble of claim 1].

The multi-chamber containers according to the invention contain, in each chamber, one component of a substrate which is produced by mixing the components and which, after being mixed, usually has to be processed within a limited period of time. In particular, the invention relates to double-chamber containers which contain two chambers separated by a chamber partition wall and each intended for one component of the substrate and which are mainly referred to hereafter for a detailed explanation of the invention. The substrates accommodated in double-chamber containers are preferably chemicals, for example an epoxy resin and its hardener or polyurethane foam obtained from two components. The correct use of such materials necessitates adherence to the prescribed pot lives and mixing conditions.

The double-chamber containers according to the invention are suitable for mixing the components and discharging the substrates, before the use of which the components introduced into the chambers are kept separate.

The multi-chamber container according to the invention can also therefore be used as a pack for the substrates, especially as a disposable pack. Its chambers then also serve as measuring cups and make the correct mixture unavoidable, thus enabling even laymen to adhere to it. The mixing of the substrate takes place in the container shortly before discharge and with the exclusion of air, this under certain circumstances being of essential importance for many substrates or their processability. Only after mixing are the closure of the container opened and the ready-made substrate discharged.

An example of the use of double-chamber containers according to the invention is fastening technology, for example in masonry composed of hollow blocks. Here, the conventional expanding dowels cannot be used because the inner walls of the hollow block cannot withstand the bursting forces of the dowel driven apart by means of a screw. In these cases, instead of the dowel, a mesh sleeve is inserted into the drillhole previously made and is filled with the hardenable substrate. A wall tie is then used, instead of a screw, the substrate solidifying round it and partially forcing its way outwards through the mesh of the sleeve. This guarantees that the wall tie resting in the hardened substrate will fit firmly in the hollow block. The epoxy resins or other substrates hitherto used for this purpose are accommodated with their correctly proportioned components in the multi-chamber container according to the invention which is often supplied together with a predetermined number of fastening means and which is discarded after the processing of the substrate. In these practical uses of the invention particularly, therefore, the new containers are largely composed of plastic.

In the double-chamber container according to the invention, the partition wall first serves for adjusting the chambers to the correct quantity of the components. Since the chamber partition wall is movable, it can be moved through the two chambers, its orifice being free, and the component located in one chamber is displaced into the other chamber and thereby mixed with the other component located in this chamber. This operation is a mixing of the lift-jet type and is therefore highly intensive, so that, as a rule, only a few strokes of the tappet are sufficient for the ready-mixing of the substrate. For discharging the substrate, the chamber partition wall is adjusted to the start of the tappet stroke and its orifice is closed. After the removal of the container closure, the substrate is discharged by means of a tappet stroke.

After the two components have been introduced into the two chambers, the shutoff member of the container according to the invention ensures that these are closed off from one another. In its open position, the shutoff member exposes the orifice for the mixing operation described. In its closed position, during the discharge of the substrate the shutoff member prevents the finished mixture from overflowing into the empty chamber and thus makes it possible for the container to be emptied completely. The chamber partition wall and the shutoff member can therefore be actuated independently of one another. The exact calculation of the components and the few requirements involved in carrying out the described processing steps in the closed container make the multi-chamber container according to the invention especially suitable for laymen and those workmen not familiar with the mixing of the substrate. The shutoff member therefore has to function perfectly, especially be leakproof up to the complete mixing of the components, and on the other hand it must be possible for it to be actuated without error, in order to produce the mixture and discharge the substrate.

The invention starts from a known double-chamber container (German Offenlegungsschrift 2,825,230). The chamber partition wall designed as a piston and a disk are accommodated in the hollow-cylindrical container which carries an outflow connection in its closed end face. The piston has several orifices arranged as a hole circle, whilst the disk resting against its rear face forms a rotatable closing slide of the shutoff member, and perforations arranged on a hole circle and located in the disk can be aligned with the orifices in the piston when mixing is to be carried out. The orifices are closed by rotating the closing slide, in order to keep the components separate and discharge the substrate.

However, the known container involves too high an outlay for the disposable packs described and for many other types of use. It requires not only the tappet, but also a rod for rotating the shutoff member and employs the tappet for the transmission of force for the purpose of moving the chamber partition wall through the container. This results in a concentric linkage which is composed of the tappet and of a tube forming the rod and which has to be actuated via separate handles. Moreover, the disk virtually doubles the thickness of the chamber partition wall and thereby reduced the effective chamber volume. It is difficult to ensure that the disk is sealed off satisfactorily on the chamber partition wall.

The invention is intended to simplify the construction and manipulation of such a multi-chamber container.

SUMMARY OF THE INVENTION

The invention achieves this object by means of the features of claim 1. The subclaims relate to further features of the invention.

According to the invention, the orifice necessary for fastening the rod in the chamber partition wall is put to multiple use, that is to say is also employed for the complete mixing of the components of the substrate.

This does away with the perforations hitherto provided for this purpose and with the disk interacting with these. The effective volume of a given container is thereby increased as a result. The orifice also serves for guiding a spindle which is screwed into an internal thread of the orifice and which, as a result of this positive connection, is used for the to-and-fro movement of the chamber partition wall through the container. This results in a simplification of the linkage which now need not be arranged concentrically.

The spindle is attached to the tappet and extends between the stop and the valve plate of the shutoff member. These two parts are screwed onto their seat alternately according to the direction of rotation of the spindle. For exposing the grooves, they are lifted off from their seats on both sides. The positive guidance by the spindle thread and the bracing forces guaranteed by this do away virtually completely with previous sealing problems. By virtue of the longitudinal grooving of the spindle thread, lift-jet mixing takes place by means of the grooves during the linear movement of the tappet. The stop prevents the spindle from being overrotated. It can also serve as a second valve plate. Such a double arrangement of the valve plates means that each of the two valve plates blocks the flow through the grooves past the thread flights when it is laid onto its seat. The direction of rotation of the tappet, by which the blocking of the through-flow is obtained, is then of no importance. In this embodiment, manipulation is greatly simplified and largely prevents the possibility of errors.

The invention therefore has the advantage of simplification because material is saved, this being essential for disposable packs. It also allows a clear separation of the various processing steps as a result of the movements of the spindle which are coordinated with these, 80 that errors, such as those which beset laymen during the mixing and discharge of the substrate, can scarcely occur at all.

By means of the features of claim 2, the multi-chamber container according to the invention avoids further considerable disadvantages which it has hitherto been impossible to prevent in the known multi-chamber containers. These arise during the discharge of the substrate as a result of the formation of a vacuum behind the advancing chamber partition wall. Since, in particular, the chamber partition wall must be reliably leakproof at the chamber walls and the cover of the container also closes in an airtight manner to prevent air from flowing into the container, during the discharge of the substrate the sliding resistance on the linkage increases sharply even after only a short advance of the chamber partition wall, thus making it difficult to discharge the substrate. If the linkage is released as the unavoidable result of work interruptions, it springs back. The chamber partition wall then sucks in external air through the opened cover of the closed end face of the container. Since with many double-chamber containers the discharge of the substrate has to be interrupted several times, the substrate thereby comes in contact with the atmosphere each time. This is frequently associated with undesirable reactions. Also, the external air can form bubbles in the substrate, and under some circumstances this diminishes its quality decisively.

Where air-sensitive substrates are concerned, the formation of a vacuum is often prevented by means of a nonreturn valve incorporated in the rear wall of the container. Such nonreturn valves are then usually also employed for introducing a component provided under the cover and consequently have a double use. However, they involve a very considerable extra outlay which is an important factor especially where disposable containers are concerned.

The solution to these problems according to the invention is reproduced in claim 2. It requires virtually no extra outlay, especially when it is put into effect by means of the features of claim 3. In particular, there occurs here the air suction, necessary for preventing the vacuum, past the valve spindle directly into the chamber via the axial recesses. In the packaging position of the chamber partition wall, in which the latter is often located in the middle of the container, the smooth cylindrical portion prevents air from penetrating into the chamber under the spindle bushing. In contrast, of the components are mixed, an expedient coordination of the free cross-section of the recesses with the viscosity of the substrate makes it possible to prevent component material or substrate material from escaping outwards. However, if the chamber partition wall is drawn back and the valve closed, the air also flows directly through the smallest orifice cross-sections.

The chamber partition wall is appropriately equipped with its own sealing. In this case, it is expedient to ensure that the rotational resistance of the chamber partition wall reduced by the seal is increased, in order to prevent it from rotating during the rotation of the tappet. The features of claim 5 take care of this.

Moreover, the features of the following claims ensure an improvement of the stackability of several containers and the packing density in bundles of predetermined size.

However, the assembly of the valve plate arranged at the free end of the spindle is comparatively difficult, because it has to be carried out after the screwing on of the chamber partition wall and requires a fastening on the relatively small cross-section of the tappet. This difficulty can be overcome by means of the features of claim 8 which can also be put into effect independently of further features of the invention which are subordinate to claim 1.

According to this embodiment of the invention, the closure is accommodated in the tappet, so that the chamber partition wall also requires only one orifice which, in hollow-cylindrical containers, it located in the center. The rod slide therefore does not reduce the chamber volume and requires only a possibility of axial movement in the tappet. The chamber partition wall consequently need not be secured against rotations about its axis. Since the chamber partition wall has no orifices outside the tappet, bus is closed, sealing difficulties are avoided. The chambers are thereby closed off reliably from one another and the complete emptying of the container during discharge is ensured. Mixing takes place by means of the jets which the substrate forms in the perforations of the tappet. There can be any number of these orifices, this number being limited only by the mechanical strength of the tappet in the plane of the perforations. These perforations can therefore be given a comparatively small orifice cross-section, thus guaranteeing intensive mixing as soon as the chamber partition wall is moved to or fro.

Preferably, and by means of the features of claim 8, this embodiment of the double-chamber container according to the invention prevents the formation of a vacuum behind the advancing chamber partition wall during the discharge of the substrate, even though the chamber partition wall is sealed reliably at the chamber walls and air is thereby prevented from flowing into the container through the cover of the container. This is achieved without a nonreturn valve incorporated in the rear wall of the container, because such nonreturn valves involve a very considerable extra outlay which is an especially important factor where disposable containers are concerned.

The solution of the problem according to claim 9 requires virtually no extra outlay because the air inflow takes place through the hollow tappet by means of one piston step and is shut off by means of the other piston step. The step-piston slide according to the invention then has three axial positions in the tappet. In the position of the slide rod drawn back furthest, the large piston at the same time closes the perforations and the orifices in the chamber partition wall. In the middle position, the larger piston closes the orifice in the chamber partition wall, but the small piston is located in front of the perforations and thus allows air to flow through the tappet into the chamber placed behind the container cover and thereby prevents the vacuum formation described. In the position of the step-piston slide drawn in furthest, the larger piston exposes the orifice in the chamber partition wall, so that the components can flow through these orifices past the smaller piston and through the perforations and be mixed.

By means of the features of claim 10, the chamber partition wall can be equipped with an annular seal which ensures the absolutely leakproof sealing off of the two chambers before the mixing of the substrate. This sealing off also allows a complete emptying of the container, because it wipes the container wall and prevents the return flow of substrate during the advance of the chamber partition wall.

According to claim 11, the container cover is likewise connected in an airtight manner to the container and fastened in such a way that air can possibly penetrate into the chamber located behind the cover. This chamber can therefore be filled without a nonreturn valve, before the attachment of the cover through which the linkage passes, and a relatively large residual air volume and the associated chemical conversions or air bubbles can be avoided in the chamber after the substrate has been introduced. This is made possible by the sleeve serving for guiding the tappet, because it has its own sealing at the tappet and is fitted only after the filling of the chamber and the fastening of the cover.

The features of claim 12 serve for the construction of the double-chamber container according to the invention by plastics technology, especially for the purposes of the disposable packs described in the introduction. These features allow a finished assembly of the container by pressing the parts together, so that, for example, these can be produced by the highly productive injection-molding technique.

Claim 13 allows error-free actuation of the chamber partition wall and of the rod slide, especially in the embodiment as a step-piston slide with the above-described three positions for improving the air-free discharge of the substrate.

With the sleeve described in claim 11, although most of the air enclosed by the cover and the chamber content can be ejected outwards, the sleeve nevertheless includes a residual volume of air which, where sensitive substrates are concerned, can result in defects. This can be avoided by means of the features of claim 14. Thus, in particular, the entire content is covered by a further chamber partition wall before the container is finally closed. This feature of the invention is therefore also capable of independent application.

BRIEF DESCRIPTION OF THE DRAWINGS

The invention is explained in detail below by means of several exemplary embodiments which are illustrated in the drawings. In these.

DESCRIPTION OF THE PREFERRED EMBODIMENTS

Figure 3:
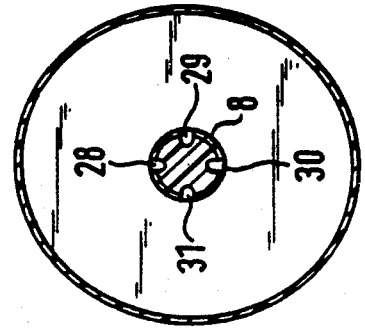
FIG. 3 is a cross-sectional view along the line III—III of FIG. 1.

The new double-chamber container (1), in the initial position of its parts (FIG. 1), has a chamber partition wall (4) axially movable through the chambers (2, 3). Because of the cylindrical form of the container (1) (FIG. 3), wall (4) is designed as a piston which, on its outer cylindrical surface, has a groove (5) for an O-ring seal (6) ensuring sealing on the inside (7) of the container. Wall (4) can have a contour differing from the circular form, to prevent it from rotating about the container axis. If the container (1) has a polygonal contour for example, the contour of its clear inner space forms the enveloping curve of the contour of the chamber partition wall (4) or of the seal (6).

The piston has an orifice (8) in the center. A connection between the two chambers (2, 3) can be made by means of this. The orifice interacts with a shutoff member designated as a whole by (9) in FIG. 1. The shutoff member is opened and closed via a tappet (10). The tappet is guided outwards through a container cover (11) and on its free end carries a knurled knob (12) as a handle. Located in the cover is an internally cylindrical perforation (13), a clearance space (14) being left between the latter and the tappet (10).

A cylindrical bushing (15) is retained non-positively in a clearance (16) of the cover and holds an O-ring seal (17) which seals off the tappet (10).

The cover (11) also possesses a two-winged handle (18), by means of which the container is held when the tappet (10) is being actuated in the axial direction through the container.

The opposite end of the container is closed by means of an annular disk (20) which forms a constructional unit with the container wall. Located in the center of the disk (20) is a tubular connection (21), through which the substrate can be discharged. This is closed by means of a removable cap (22).

Figure 2:
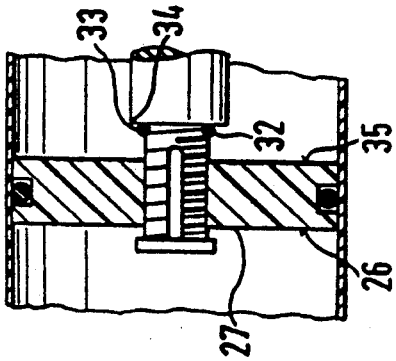
FIG. 2 is a fragmentary detail of the view of FIG. 1.

The orifice (8) in the chamber partition wall (4) is aligned with the tappet (10). This forms a spindle screwed by means of its thread (23) into the orifice (8) and belonging to a plate valve with two plates which are formed at the thread ends. The seat of one valve plate (24) is formed on the front side (26) of the chamber partition wall (4) at (27) (FIG. 2). Since the parts are composed of flexible plastic, no special sealing is required.

The spindle thread (23) is multiply grooved, the grooves reaching as far as the valve plate (24).

As emerges from FIG. 3, four grooves (28–31) offset respectively by the amount of a quarter circle relative to one another are provided in the exemplary embodiment. The grooves are brought to just in front of the thread start (32), but terminate at a distance from this. An O-ring seal (33) rests on the thread end (32) and is supported on an annular collar (34) which forms the inner end of the rod cylinder (19) and which acts as a second valve plate.

The spindle thread (23) serves as a tension-resistant and pressure-resistant connection between the tappet (10) and the chamber partition wall (4). Furthermore, during the rotation of the tappet by means of the knob (12), it performs the function of alternately laying the valve plate (24) or the O-ring seal (32) onto and lifting it off from an annular sear on the rear side (35) of the chamber partition wall (4), so that the second valve plate (24) ensures sealing.

The outer cylinder (79) of the rod (10) has axial recesses (36–40). These are aligned axially, but leave a cylinder portion (41) free. Over this length, in the middle position of the chamber partition wall (4) illustrated in FIG. 1, the spindle bushing is sealed off by means of the O-ring seal (17).

Figure 1:
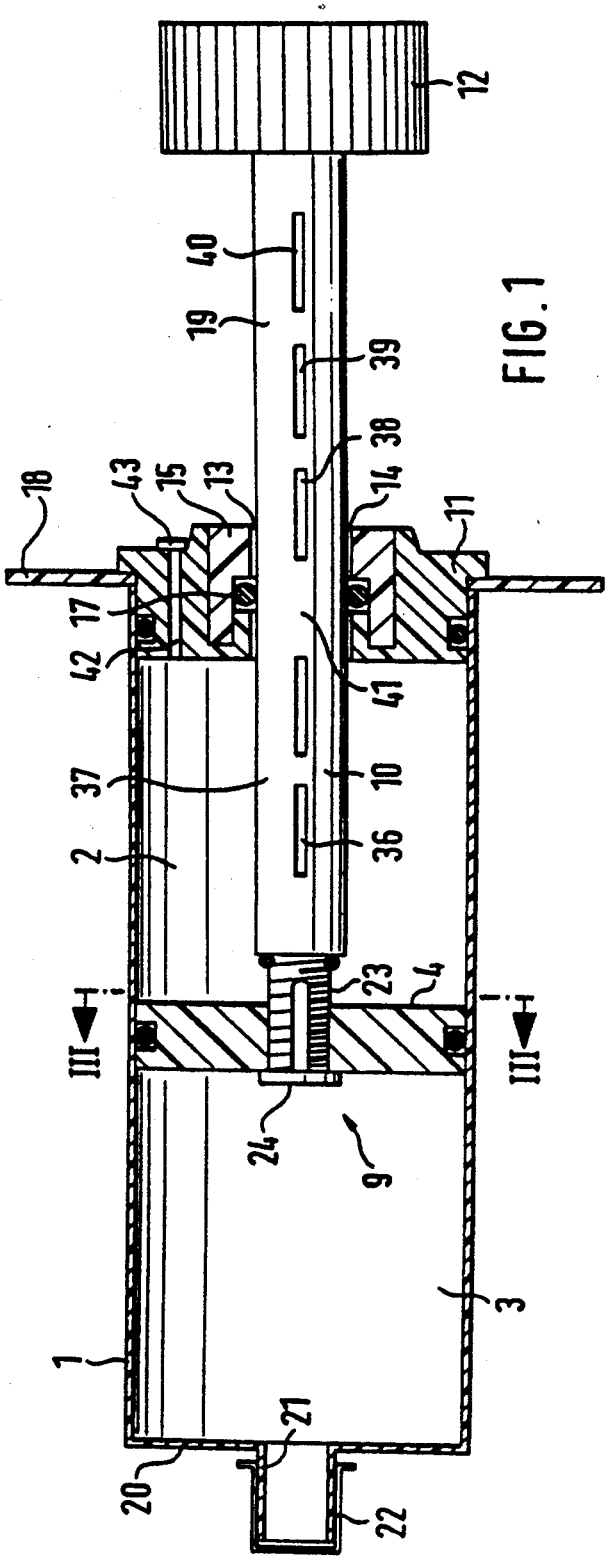
FIG. 1 is a longitudinal sectional view of a double-chamber container according to the invention shown in an initial position.

The position of the parts according to FIG. 1 is assumed first. In this, the chamber partition wall is in a position in which the volumes in the chambers (2, 3) are set. By rotating the rod (10) to the left until the valve plate (24) comes up against the seat (27), the chambers are closed off from one another. With the cover (22) open, the component to be accommodated in the chamber (3) is introduced through the connection (21). The other component is introduced through an orifice (42) in the cover (11) which is then closed by means of a plug (43). The filling of the chamber (2) displaces the enclosed air through the clearance in the cover (11), before the bushing (15) and O-ring seal (17) are attached. This takes place only after the complete filling of the chamber (2), thus preventing air inclusions.

After the tubular connection 921) has been closed by means of the cap (22), the two components in the chambers (2, 3) are closed off from one another and from the outside in an airtight manner.

As soon as the substrate is to be produced, the position of the parts according to FIG. 2 is adopted by rotating the knurled know (12) to the right. The valve plate (24) is thereby lifted off from its seat (27) and the lift-jet mixing takes place through the grooves (28–31) during the axial movement of the rod (10) by means of the knurled know (12).

Figure 4:
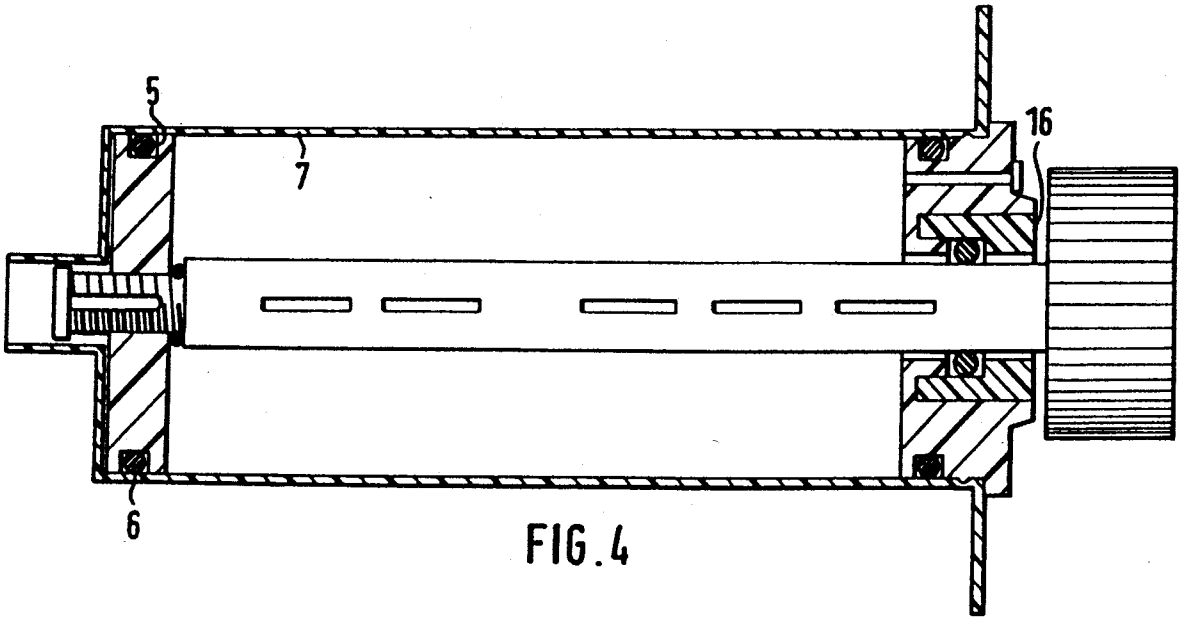
FIG. 4 is the view of FIG. 1 in a discharge position.

As soon as the substrate has been ready-mixed as a result of one or more successive strokes, the valve plate (24) is lifted off from its seat (27) completely as a result of a further rotation of the know (12) to the right, until the O-ring seal (33) ensures sealing on the side (35) of the chamber partition wall (4) and at the annular flange (34). This position of the parts is illustrated in FIG. 4. It serves for pressing the substrate out of the container (1) by means of the piston initially drawn back into the cover (11), the cap (22) being removed from the tubular connection (21). Pressing out takes place as a result of an axial movement of the tappet (10). If the user mistakes the direction of rotation, the valve plate (24) is laid down and the result is the same. The rod need therefore only be rotated as far as it will go each time when mixing has ended and the chamber partition wall is drawn back. For mixing, the rod need only be freely rotatable. Errors are therefore virtually impossible.

During pressing, air flows through the said recesses (36–40) on the outer cylinder (19) of the rod (10) into the enlarging chamber (2) and prevents a vacuum from forming there.

Between the chamber partition wall (4) and the cover (11), it is possible to accommodate in the container one or more further chamber partition walls which make it possible to obtain more than two chambers and which, for mixing purposes, are pushed back against the cover (11), by means of the chamber partition wall fixed to the tappet, before the substrate is discharged.

Figure 5:
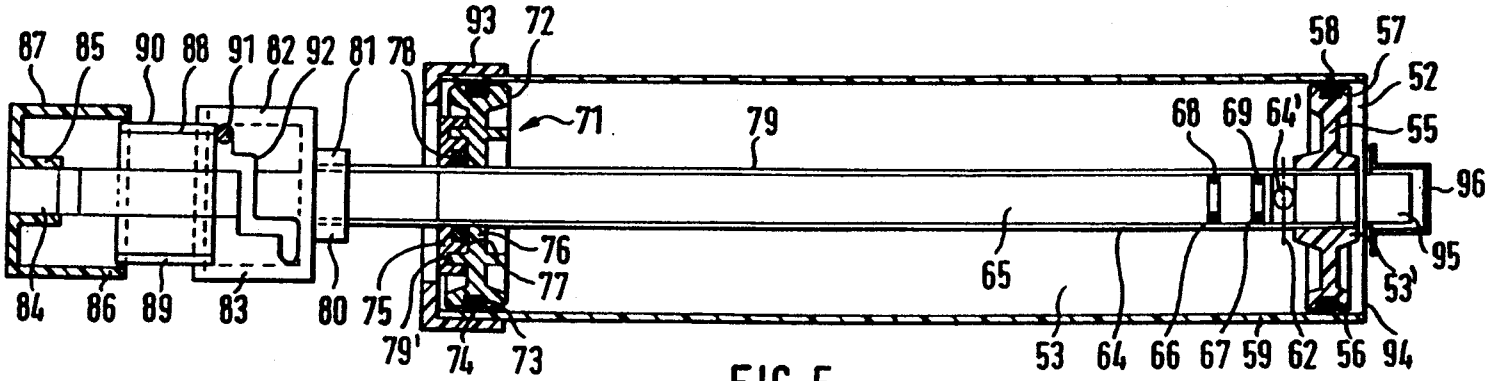
FIG. 5 is the view of FIG. 1 of a second embodiment of the invention, showing a position necessary for the complete mixing of components.

According to the illustration of FIG. 5, the double-chamber container (51) has a chamber partition wall (52) movable through the chamber. The container is formed by a hollow cylinder (53). The chamber partition wall is therefore an annular disk. This rests fixedly in terms of rotation on a hollow tappet (54) by means of a hub (53'). Attached to the outer periphery of the disk wall (55) is a rim (56). This has an annular groove (57) for an O-ring (58). The latter ensures sealing on the inside (59) of the hollow cylinder (53). According to the illustration in FIG. 6, the chamber partition wall has, in its hub, a central orifice (60), the free cross-section of which is limited by the end (61) of the hollow cylinder of the tappet.

Behind the hub (53'), a plurality of perforations (64) are arranged in the hollow tappet cylinder (54) next to one another in a common plane (62) over a hole circle. A connection between the chambers is made by means of the orifice (61) and the perforations (64).

A rod (65) is guided in the hollow tappet cylinder (54). The rod end has annular grooves (66 and 67) arranged at a distance from one another and functioning as a seat for O-ring seals (68 and 69) which ensure sealing on the inside of the hollow tappet cylinder (54). The rod end thereby forms a closing slide (70) for the orifice (60) and for the perforations (62).

FIG. 5 shows that the tappet (54), serving for moving the partition wall (52), and the rod (65), guided in it and used for opening and closing the closing slide (70), are guided through a cover (71) of the hollow cylinder (53). In the exemplary embodiment, the cover (71) is similar to the chamber partition wall (52). It has, together with this, a rim (72) with an annular groove (73) for an O-ring seal (74): A sleeve (75) surrounds the tappet (54) and, together with the disk (76), forms the seat (77) of an O-ring (78) which ensures sealing on the outer cylinder (79) of the tappet. The sleeve (75) is pressed onto an annular rib (79') of the cover (71) and is held positively by this.

The tappet cylinder (54) is equipped with key faces at its end (80). These guarantee a positive connection with a socket (81) which forms a constructional unit with a sleeve (82) and which is equipped with gripping grooves (83) on its outside. The hollow cylinder or tappet (54) can be moved axially by means of the sleeve (82), the chamber partition wall (52) being taken up.

The rod (65) is itself equipped with key faces at its end (84). These interact with a bushing (85) of a handle or sleeve (86), thereby producing a positive connection which makes a rotationally fixed connection of the rod (65) to the sleeve (86). The sleeve (86) is likewise equipped with gripping grooves (87) on its outside. It forms a constructional unit with a sleeve (88) which has two longitudinal slits (89 and 90). A cam (91) is formed in one piece with the sleeve (88) and runs in a slot (92). The slot is located in handle or sleeve (82) and by its two ends defines a retracted position, illustrated, in which the O-ring seals (68, 69) expose the perforations (64) and the orifice (60), and an advanced position, in which the O-ring seals are laid down in the hub (53') of the chamber partition wall (52) and thereby close the orifice (60) and the perforations (64).

Figure 6:
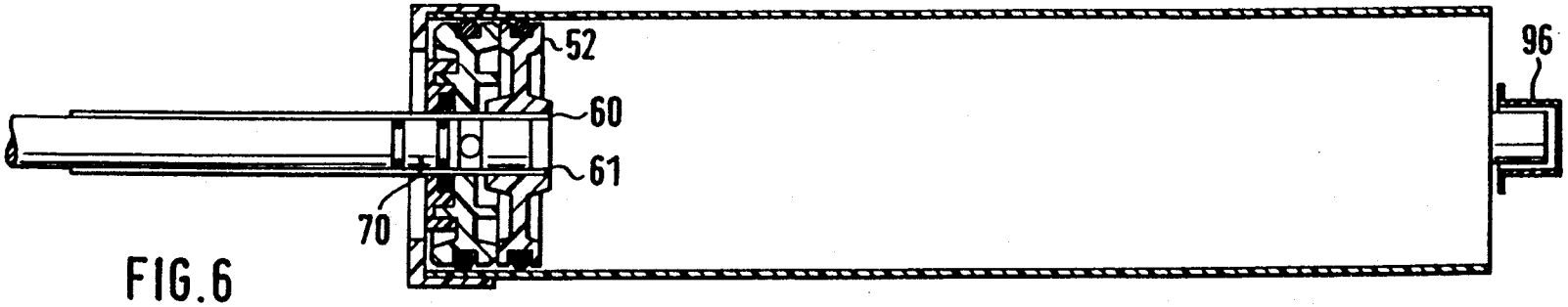
FIG. 6 is the view of FIG. 5, showing the parts during mixing.

By actuating the handle (82), the chamber partition wall is brought into an intermediate position located between the extreme positions which are illustrated in FIG. 5 and 6. Furthermore, the linkage composed of the rod (65) and of the hollow cylinder (54), including the handles (82 and 86), is ready assembled, but the cover (71) and the sleeve (75) are merely slipped on together with a coupling nut (93) which, by means of an annular flange, can engage over the associated end of the hollow cylinder (53). The opposite end of the hollow cylinder is closed by means of an annular flange (94), to which a discharge connection (95) is attached. The discharge connection (95) is hollow-cylindrical. It can receive a nozzle or a tube. The discharge connection (95) itself has a cover (96) which is first removed.

In the position of the parts, as described, the two chambers can each be filled from the end face. The cover (96) is then fastened to the connection (95) and the component located in the associated chamber is thereby closed off in an airtight manner. The other chamber is closed off by pushing on the cover (71), the chamber content reaching as far as the cover. The cover (71) is fixed by means of the coupling nut (93). The sleeve (75) is subsequently pressed in, so that the chamber is closed off in an airtight manner. The pressing in of the sleeve prevents air from being enclosed at the chamber end. The two chambers are thus closed to the outside and relative to each other in an absolutely leakproof manner.

Normally, the cam (91) rests in the inner end of the slot, with the result that the orifice (60) and the perforations (64) are sealed off. This prevents the possibility of a mixing of the two different components in the chambers.

In this position of the parts, the two components of a substrate are correctly calculated and can be transported and stored without any problem.

The substrate is produced shortly before its use. For this, the cam (91) is first shifted into the position illustrated in FIG. 5. The connection between the two chambers by means of the orifice (60) and the perforations (64) is thereby made. By means of the handle (82), the chamber partition wall (52) is moved axially to and fro for the complete mixing of the two components. These components thus pass through the orifice (60) and the perforations (64), with the result that intensive mixing is obtained.

At the end of the mixing operation, the parts assume the position evident from FIG. 6. Before the substrate is discharged, the cam (91) is first shifted into the other extreme position in the slot (92). Passage through the orifice (60) and the perforations (64) is thereby closed. The cover (96) is then removed, thus exposing the connection (95). By means of the handle [(87)] (86), the linkage composed of the tappet (54) and rod (65) is pressed in, with the result that the chamber partition wall (52) is moved towards the connection (95) and the substrate is discharged.

Figure 7:
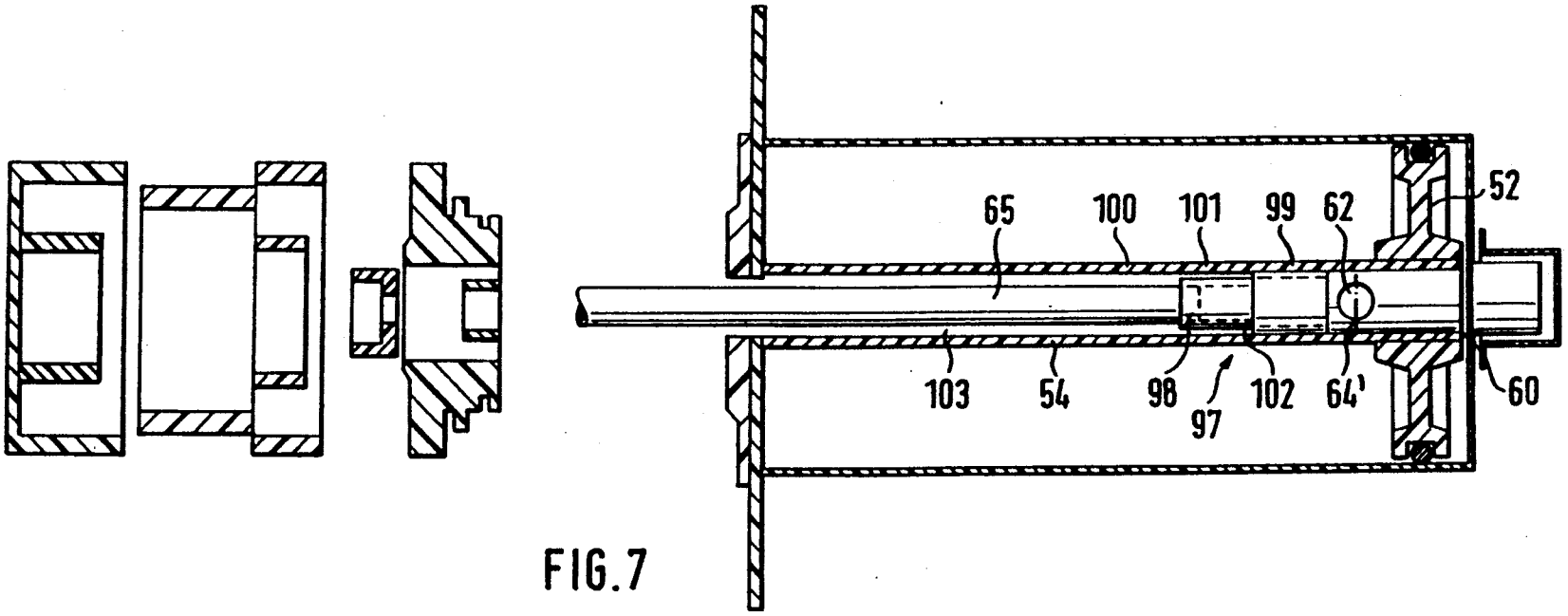
FIG. 7 is a fragmentary view of the view of FIG. 5, showing a modification of the second embodiment of the invention.

The modified embodiment according to FIG. 7 uses a step piston (97) instead of the O-ring seals (68 and 69). The step piston is formed by a stepped hollow cylinder which is connected non-positively at its smaller end to the end (98) of the rod (65). The larger piston (99) forms the free end of the step piston and ensures sealing on the inside (100) of the hollow tappet cylinder (54). Between the smaller piston (101) and the inner cylinder (100) of the tappet (54) remains an annular space (102). This is connected to an annular space (103) present between the outer cylinder of the rod (65) and the inner cylinder of the tappet (54). The annular space (103) is connected to the atmosphere, specifically as a result of the play of the outer rod end in the socket (81) relative to the tappet.

In the position of the parts evident from FIG. 7, the larger piston (99) is drawn back behind the perforations (64) in the plane (62). The orifice (60) is thereby exposed. There is a connection between the two chambers by means of the orifice (60) and the perforations (64). When the cam (91) (FIG. 5) is placed on the middle track of the slot (92), the larger piston (99) is shifted over the orifice (64) and thereby at the same time closes the orifice (60). The connection between the two chambers is thus broken. This position is assumed by the parts when the chambers are filled and the components are to be stored until the substrate is processed. When mixing is completed, the cam (91) is in the inner end of the slot (92). The orifice (60) is consequently closed, but the path through the annular spaces (103 and 101) and perforations (64) into the chamber located in the cover is open. Thus, when the chamber partition wall (52) assumes the position shown in FIG. 6, during the following tappet stroke air can enter the chamber located in the cover from the atmosphere through the annular spaces described and prevent a vacuum from forming there.

Figure 8:
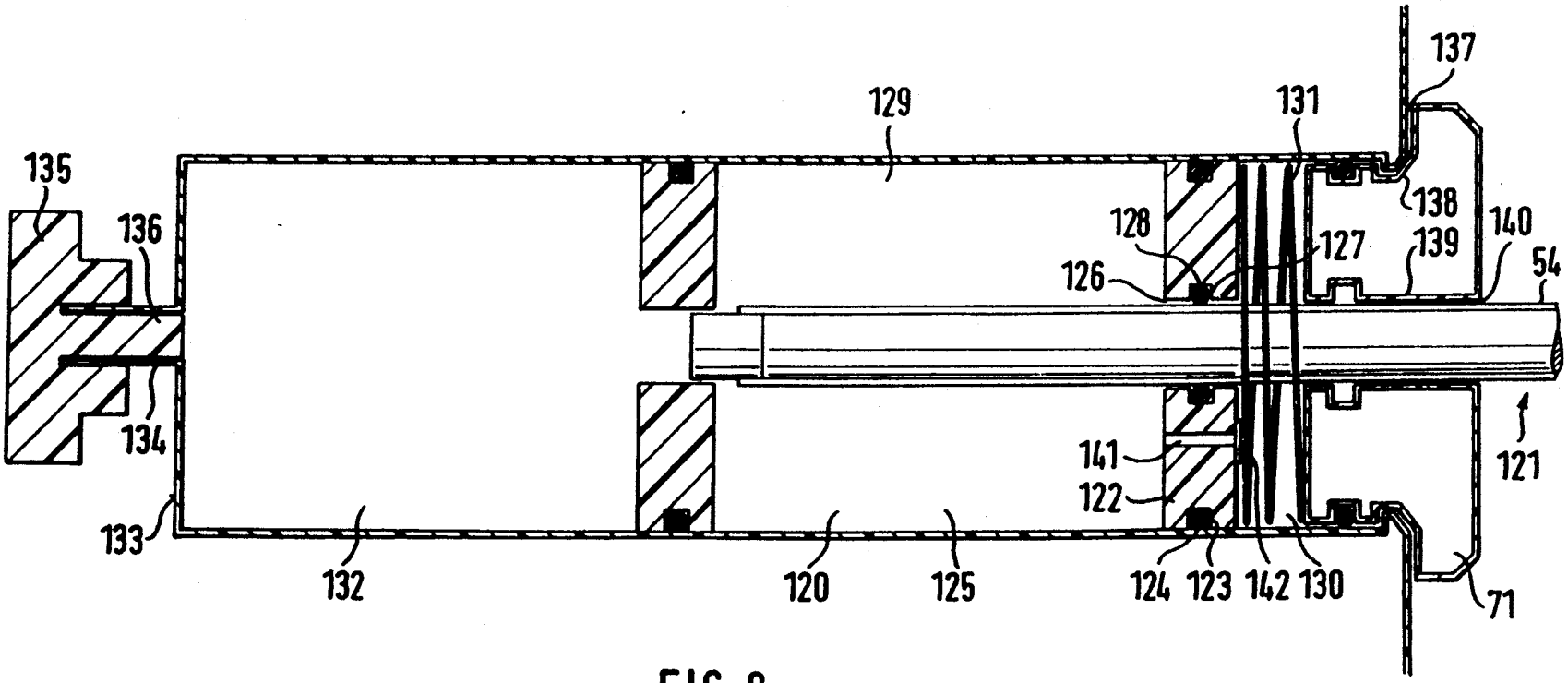
FIG. 8 is the view of FIG. 1 of a third embodiment of the invention.

In the illustration of the exemplary embodiment of FIG. 8, the chamber partition wall (52) and the parts, interacting directly with this are not shown in detail, having been described above relative to FIGS. 5-7. The hollow linkage which is formed from the tappet (54) and from the rod (65) can be seen as linkage (121) in FIG. 8. Arranged on the tubular linkage is a further chamber partition wall (122) shown diagrammatically in FIG. 8 and likewise having the form of an annular disk which, on its periphery, possesses an annular groove (123) as the seat of an O-ring (124) ensuring sealing on the inner cylinder (125) of the container (120). Located in a central orifice (126), through which the linkage (121) is guided, is an annular groove (127) for an O-ring (128) which ensures sealing on the outer cylinder of the tappet (54).

By means of this arrangement, the chamber (129) formed in the container (120) behind the first chamber partition wall (52) not shown is sealed off hermetically from a third chamber (130). At the same time, the chamber partition wall (122) is supported on a helical spring (131) which itself is supported on the cover (71) and is arranged in the chamber (130). In the exemplary embodiment, the flights of the helical spring rest against the inner cylinder (125) of the container (120).

According to the embodiment of FIG. 8, the chamber located in front of the chamber partition wall (52) is filled by means of the tubular connection (134) arranged in the container bottom (133), before the cap (135), carrying a plug (136) fitting into the tubular connection (134), is screwed onto the tubular connection. As a rule, this component is not particularly susceptible to a residual enclosed air volume.

Before the chamber partition wall (122) is pushed onto the linkage (121), the second component of the substrate is introduced into the chamber (125). The chamber partition wall (122) then pushed onto the linkage (121) is placed against the filling with this substrate, with the result that all the air escapes round the seals (124, 128). The cover (71) is then fastened on the container (120), the spring (131) being tensioned at the same time, and according to the exemplary embodiment this can be carried out by the engagement of an annular flange (137) in one piece with the container into an annular groove (138) on the outer periphery of the cover. The filling and assembly steps described can be carried out automatically in a filling machine.

At the place where the substrate is to be used, the mixing of the components first takes place, as described with reference to the illustrations of FIG. 5 to 8. During this, atmospheric air can enter the annular space (139) between the orifice (140) of generous size, for leading through the linkage (121), and the linkage, but cannot go past the seal (124 and 128) of the partition wall (122) which therefore remains against the filling. This is the case even when, after the slide has been adjusted, the ready-mixed substrate is pressed out of the connection (134) after the removal of the cap (135). At the same time, the formation of a vacuum in the chamber (130) is prevented.

In FIG. 8, a preferably cylindrical clearance (141) passes axially through the chamber partition wall (122) and belongs to a further exemplary embodiment intended for substrates composed of a mixture of three components. These are, for example, phenol resin foams which harden when the substrate is discharged. Such foams can be used, for example, for the production of free forms. If flower arrangement bases are produced from the phenol resin foam, completely new ikebana arrangements can be created.

In this case, the third component is accommodated in the chamber (130), a film strip (142) being glued onto the rear side of the chamber partition wall (122). This film strip prevents the possibility that the content of the chamber (130) will mix with the content of the chamber (129) before the substrate is produced. When the first chamber partition wall (52) is moved in the container (120) for the purpose of mixing the components, the film strip comes away as a result of the pressure increasing in the clearance (141) and no longer returns to its seat. As a result, all three components are thereby mixed.

The sealing of the clearance (141) can also be obtained by means of a plug which, like the film strip, comes away from its seat. These embodiments can be put into effect separately, that is to say independently of the features described above.

We claim:

1. A multi-chamber container, comprising:

at least two chambers, defined by at least one chamber partition wall;

at least one chamber partition wall, disposed between said chambers, movable through the container, and having at least one orifice defined therein which interconnects said chambers and which is adapted to receive a threaded valve spindle;

a shutoff member movable between an open position, wherein said chambers are connected by said orifice, and a closed position, wherein said orifice is blocked;

a tappet operably connected with said shutoff member and actuable from outside the container;

a threaded valve spindle disposed in said orifice and operably connected with said tappet for rotation of said spindle in said orifice, said spindle having a terminal end defining a stop for abutting a first side of said chamber partition wall in sealing contact, said spindle having a valve plate at a second end for abutting a second, opposite side of said chamber partition wall in sealing contact, said valve plate and said stop being layable onto the respective sides of said chamber partition wall as a result of alternating rotation of said tappet, said shutoff member being a portion of said spindle and being defined by longitudinal grooves on said spindle extending as far as said stop at said terminal end of said spindle and terminating in front of said valve plate.

2. A multi-chamber container as claimed in claim 1, further including vent means for ventilating one of said chambers when said shutoff is in said closed position.

3. A multi-chamber container as claimed in claim 1, wherein said tappet is a cylindrical member having an array of axially extending recesses arranged on its outer cylindrical surface said array defining a smooth cylinder midportion of said tappet.

4. A multi-chamber container as claimed in claim 1, further including an O-ring encompassing said spindle at said valve plate.

5. A multi-chamber container as claimed in claim 1, wherein the container is internally cylindrical with a non-circular cross-sectional shape and said chamber partition wall has a corresponding cross-sectional shape.

6. A multi-chamber container as claimed in claim 1, wherein the container has a polygonal interior cross-sectional shape, said chamber partition wall has a corresponding cross-sectional shape, said chamber partition wall has a perimeter edge with a perimeter groove defined therein, and an O-ring seal is located in said perimeter groove for sealing between said container and said chamber partition wall.

7. A multi-chamber container as claimed in claim 1, wherein said container has an interior cross-sectional shape including rounded corners and said chamber partition wall has a corresponding cross-sectional shape.

8. A multi-chamber container as claimed in claim 1, wherein said tappet is hollow, said orifice opens into said hollow tappet, said tappet further includes at least one perforation whereby said chambers are interconnected by said orifice through said hollow tappet and said perforation, and said shutoff is positioned in said hollow tappet, said shutoff blocking said perforation when in said closed position.

9. A multi-chamber container as claimed in claim 8, wherein said tappet is a hollow cylinder and said shutoff includes a piston in sealing, slideable contact inside said tappet and a piston rod connected to said piston and which forms an annular space with said tappet, said vent means being defined by said annular space.

10. A multi-chamber container as claimed in claim 8, wherein said perforation in said hollow tappet is positioned near said chamber partition wall, said chamber partition wall having a perimeter edge defining a seat adapted to receive a sealing ring.

11. A multi-chamber container as claimed in claim 8, further including a cover for closing the container said cover including a first sealing ring for sealing between said cover and the container, and wherein said tappet passes through said cover, said cover including a second sealing ring for sealing between said cover and said tappet.

12. A multi-chamber container as claimed in claim 8, wherein said cover is press fit onto the container.

13. A multi-chamber container as claimed in claim 8, wherein said tappet extends out of the container to a terminal end adapted to form a first handle, said shutoff extends out of said tappet, beyond said first handle, to a terminal end adapted to form a second handle, and said first and second handles are interconnected by cam means for controlling movement of said shutoff between said open and closed positions by manipulation of said second handle relative to said first handle.

* * * * *

UNITED STATES PATENT AND TRADEMARK OFFICE
CERTIFICATE OF CORRECTION

PATENT NO. : 5,143,211

DATED : September 1, 1992

INVENTOR(S) : Lothar Miczka et al.

It is certified that error appears in the above-identified patent and that said Letters Patent is hereby corrected as shown below:

Column 2, line 54;
"reduced" should be --reduces--.

Column 4, line 45;
"it" should be --is--.

Column 7, line 23;
"sear" should be --seat--.

Column 7, line 46;
"921)" should be --21--.

Column 7, line 52;
"know" should be --knob--.

Column 7, line 56;
"know" should be --knob--.

UNITED STATES PATENT AND TRADEMARK OFFICE

CERTIFICATE OF CORRECTION

PATENT NO. : 5,143,211

DATED : September 1, 1992

INVENTOR(S) : Lothar Miczka et al.

It is certified that error appears in the above-identified patent and that said Letters Patent is hereby corrected as shown below:

Column 7, line 60;
"know " should be --knob--.

Column 9, line 66;
delete "[87]".

Signed and Sealed this

Eighteenth Day of January, 1994

*Attest:*

Bruce Lehman

BRUCE LEHMAN

*Attesting Officer*

*Commissioner of Patents and Trademarks*